US005890926A

United States Patent [19]

Pauza et al.

[11] Patent Number: 5,890,926

[45] Date of Patent: Apr. 6, 1999

[54] CABLE BEND CONTROLLER

[75] Inventors: William Vito Pauza, Palmyra; Harold William Kerlin, Halifax, both of Pa.

[73] Assignee: The Whitaker Corporation, Wilmington, Del.

[21] Appl. No.: 825,008

[22] Filed: Mar. 26, 1997

[51] Int. Cl.[6] ..... H01R 13/56

[52] U.S. Cl. ..... 439/445

[58] Field of Search ..... 439/449, 453–459, 439/445, 581, 582, 585, 866, 867

[56] References Cited

U.S. PATENT DOCUMENTS

| | | | |
|---|---|---|---|
| 2,952,823 | 9/1960 | Robinson | 439/582 |
| 3,732,527 | 5/1973 | McKnight | 339/103 M |
| 3,793,616 | 2/1974 | Moehrke | 439/867 |
| 4,073,565 | 2/1978 | Raymond | 439/867 |
| 4,136,922 | 1/1979 | Grebik | 439/854 |
| 4,173,386 | 11/1979 | Kauffman et al. | 439/852 |
| 4,531,807 | 7/1985 | Trigon | 439/866 |
| 4,564,255 | 1/1986 | Kirma | 339/103 R |
| 4,678,261 | 7/1987 | Mitani et al. | 439/582 |
| 4,802,864 | 2/1989 | Michaels et al. | 439/457 |
| 4,863,396 | 9/1989 | Johnson | 431/470 |
| 5,037,175 | 8/1991 | Weber | 385/76 |

*Primary Examiner*—Neil Abrams
*Assistant Examiner*—Brian J. Biggi
*Attorney, Agent, or Firm*—Katherine A. Nelson; Anton P. Ness

[57] ABSTRACT

A cable bend controller (50) comprising a relatively rigid member includes a body section (52) having first and second cable-engaging sections (56,60) at opposing ends thereof. The first and second cable-engaging sections (56) are securable to a cable at a first and second spaced apart locations. The said body section (52) is curved about a preselected radius such that said first cable-engaging section (56) is oriented at a substantial angle to said second cable-engaging section, (60) the body section thereby defining an externally arcuate concave cable-engaging surface (54). Upon fastening the first and second cable-engaging sections (56,60) to the cable (42), cable (42) is required to assume a bend to lie along said externally arcuate concave cable-engaging surface (54).

18 Claims, 4 Drawing Sheets

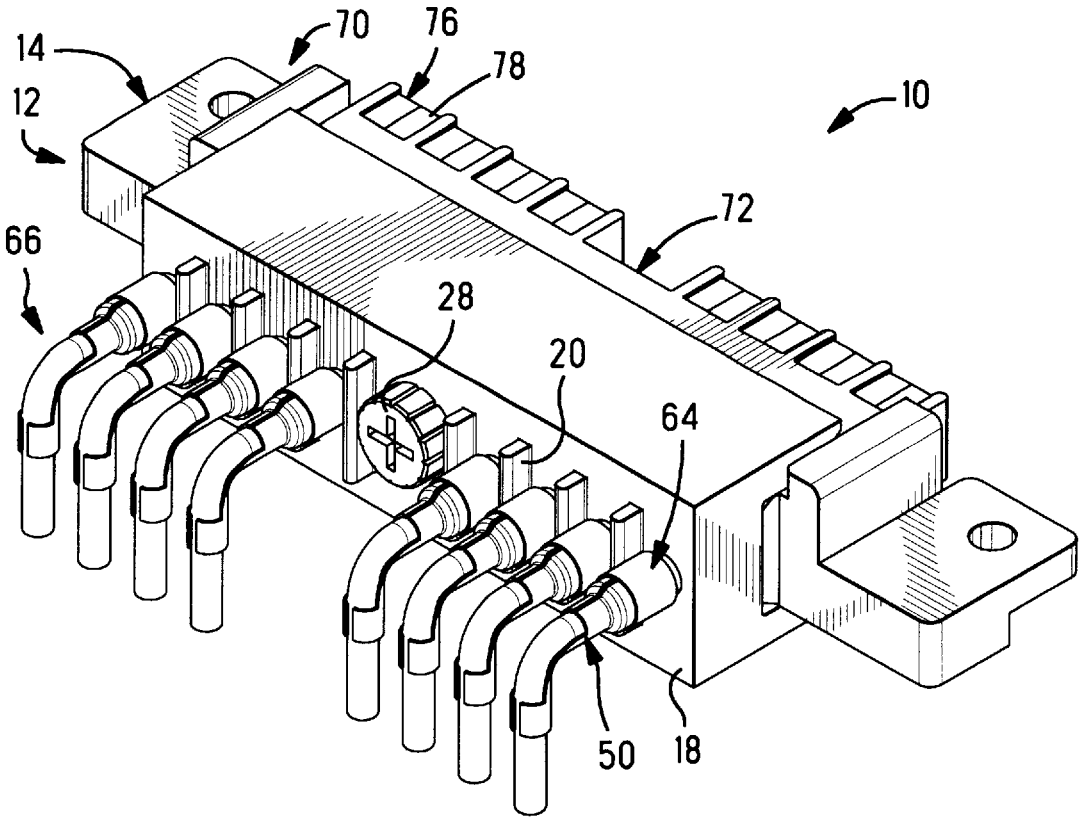
FIG. 1
FIG. 3
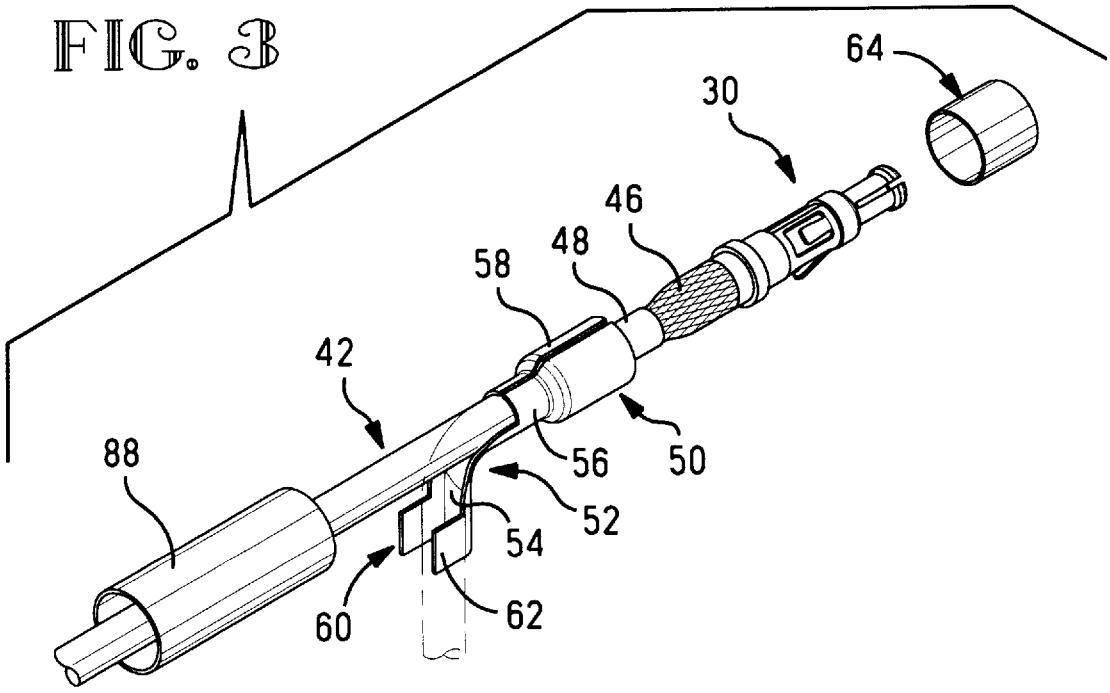

CABLE BEND CONTROLLER

FIELD OF THE INVENTION

This invention is directed to devices used to control the path of cables and more particularly to control the path of electrical cables securable to an electrical connector.

BACKGROUND OF THE INVENTION

It is known that it is desirable to control the radius or curve of cables, particularly electrical cables, as they are routed through or within an assembly in which they are used. It is important that when the conductors or wires are dressed, particularly at a 90° angle or sharper that they are not bent sharply and thus damaged. This is of particular concern when the cable is a coaxial cable and a sharp bend or "kink" can cause localized impedance mismatch of the coaxial cable. This problem is particularly of concern when discrete cables or wires are terminated to terminals disposed in a housing and at least some of the discrete wires need to be dressed at a 90° angle to the connector housing to exit a card cage or the like.

SUMMARY OF THE INVENTION

The present invention is directed to a cable bend controller that alleviates problems associated with prior art. The cable bend controller comprises a relatively rigid member having a body section with first and second cable-engaging sections at opposed ends thereof. The first cable-engaging section is securable to a cable at a first location and the second cable-engaging section is securable to the cable at a second location spaced from the first location. The body section is curved about a pre-selected radius such that the first cable-engaging section is oriented at a substantial angle relative to the second cable-engaging section between the two cable-engaging sections. The body section defines an externally arcuate concave cable-engaging surface. Upon fastening the first and second cable-engaging sections to the cable, the cable is required to assume a bend to lie along the externally arcuate concave cable-engaging surface. For purposes of illustrating the invention, the cable bend controller is used to control the bend of each of a plurality of discrete cables terminated to individual electrical terminals disposed in a connector housing. It is to be understood that the cable bend controller may be used along any section of a cable whether or not the cable is terminated to an electrical terminal or secured in an housing.

The electrical terminal includes an insulative housing having a mating face and a cable-engaging face and at least one cable bend controller secured to a cable. The first cable-engaging section is securable to the cable proximate the cable-engaging face of the housing and the second cable-engaging section is securable to a cable at a second location spaced from the cable-engaging face. The body section of the cable controller is curved about a pre-selected radius so that the first and second cable-engaging sections are oriented at a substantial angle relative to each other. Upon securing the controller to the housing with the first cable-engaging section at least adjacent the cable-engaging face, the cable is required to assume a bend to lie along the externally arcuate concave cable-engaging surface extending from the housing.

In one embodiment, each of the discrete cables are terminated to respective terminal members that are disposed in terminal-receiving passageways of the housing.

The present invention provides a device having a controlled radius to prevent discrete cables from being bent at too sharp an angle and to eliminate "kinks" and their associated problems. Additionally the device may be used as a separate entity or may be formed integrally with a crimp ferrule for termination to an electrical terminal, such as a coaxial terminal. The invention provides a cost effective device that may be readily stamped and formed from a strip of metal and requires only a minimum number of manufacturing and assembly steps.

Embodiments of the invention will now be described by way of example with reference to the following drawings.

BRIEF DESCRIPTION OF THE DRAWINGS

FIG. 1 is an isometric view of a connector assembly having a plurality of cables terminated thereto each cable including the bend controller made in accordance with the present invention.

FIG. 3 is an exploded view of the cable, the terminal and the bend controller made in accordance with the present invention.

DETAILED DESCRIPTION OF THE DRAWINGS

Figure 2:
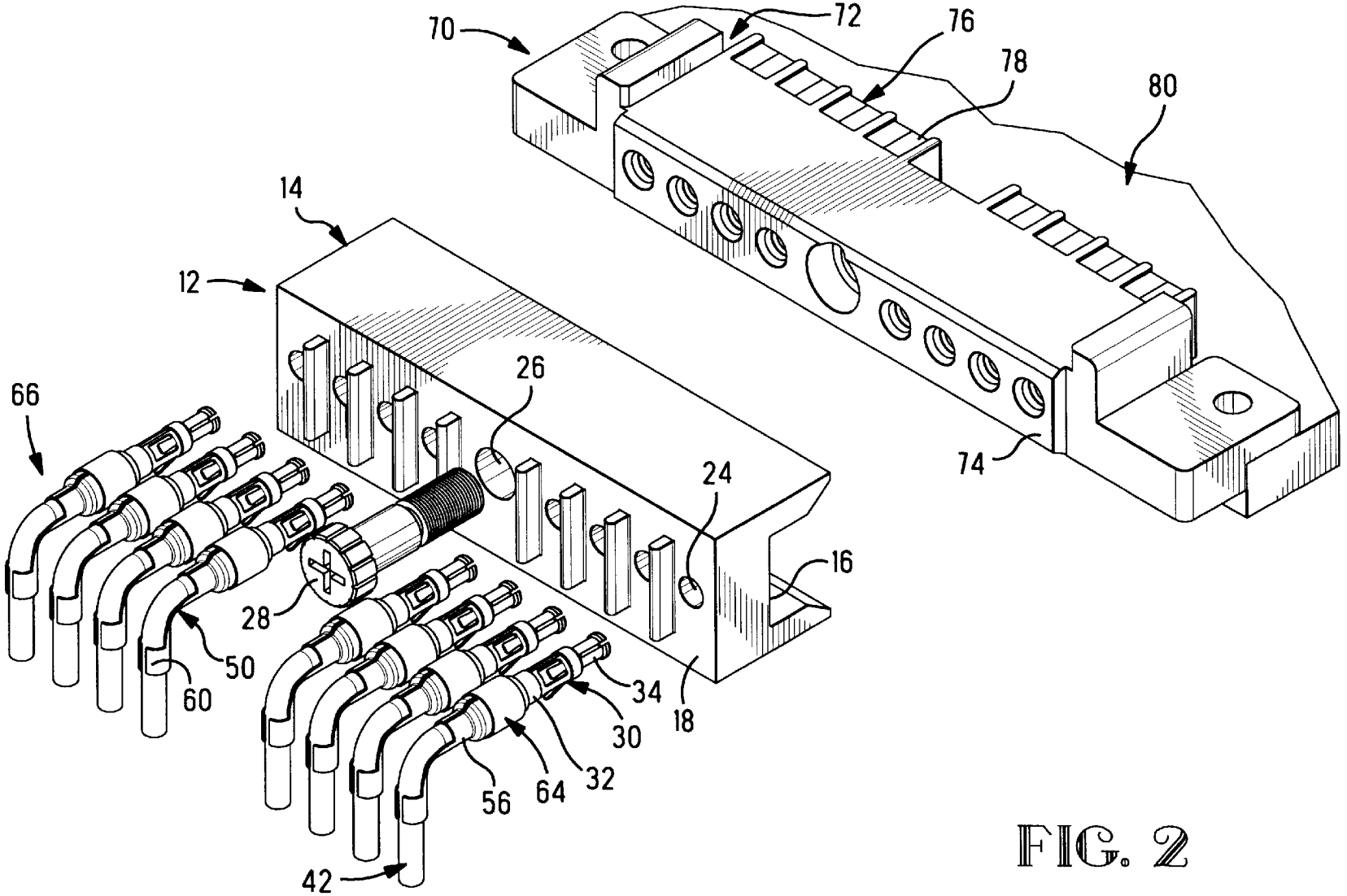
FIG. 2 is a particularly exploded view of the assembly of FIG. 1.

For purposes of illustrating the invention the cable bend controller is being shown being used with an electrical connector assembly 10 including first and second connectors 12, 70. Connector 12 includes a plurality of discrete cables 42 each having a bend controller 50 disposed thereon. The cables are terminated to respective electrical terminals 30 in housing 12. For purposes of illustration, cable 42 is shown as a coaxial cable and terminal 30 is a coaxial terminal. It is to be understood that the invention is not limited to being used with coaxial cables and terminals.

Referring now to FIGS. 1 through 4, connector 12 includes a housing 14 having a mating face 16 and a cable-engaging face 18 and a plurality of terminal receiving apertures 24 extending therethrough. Cable-engaging face 18 further includes a plurality of ribs 20 extending between the respective ends of passageways 24 to provide a dielectric barrier to increase the surface distance between adjacent terminated cables, thereby increasing the voltage values. Housing 14 further, as shown herein, includes an aperture 26 extending therethrough for receiving a fastener 28 to secure housing 12 to housing 70, as shown in FIG. 1.

Figure 4:
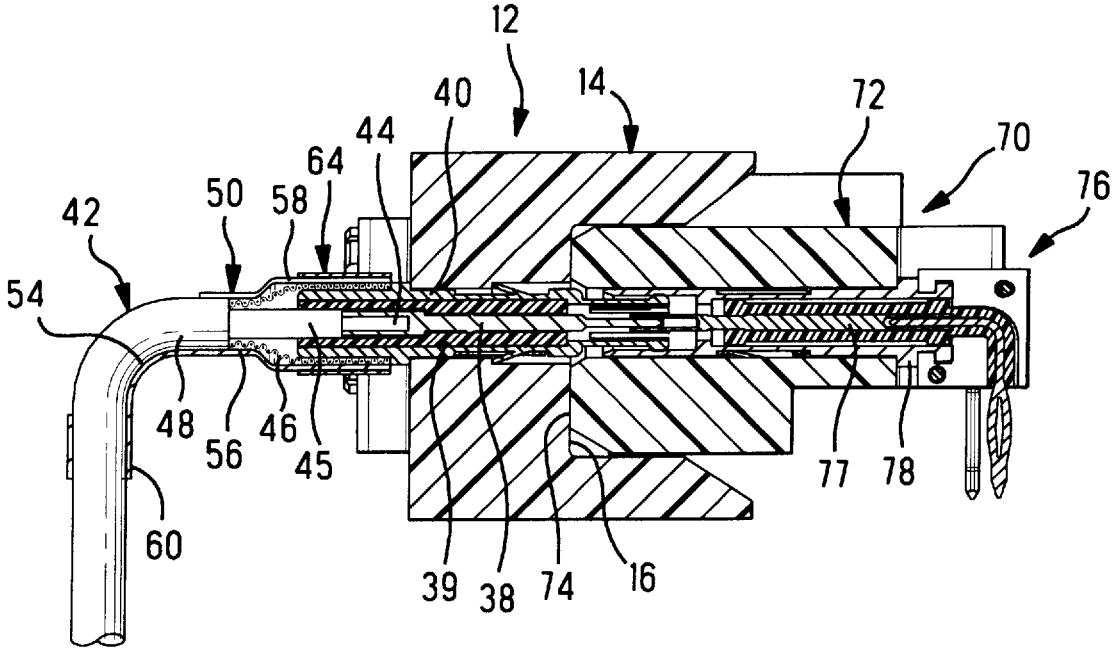
FIG. 4 is a cross-sectional view of the assembly of FIG. 1.

Coaxial cable 42 includes inner or signal conductor 44, surrounded by an insulating layer 45 and outer conductor or braid 46, as best seen in FIG. 4.

Coaxial terminal 30, as best seen in FIGS. 3 and 4, includes a body 32 having a first connecting portion 34 adapted to mate to into a corresponding terminal 76 in connector 70 and a second connecting portion 36 adapted to be terminated to cable 42. Terminal 30 includes an inner or signal contact 38 and an outer or ground contact 40 that are to be terminated to a respective inner or signal conductor 44 and to outer conductor or braid 46 of coaxial cable 42 by crimping or other means as known in the art.

The cable bend controller 50 includes a body section 52, a first cable-engaging section 56 and a second cable-engaging section 60. The body section 52 is curved about a preselected radius such that the first connecting section 56 is oriented at a substantial angle to the second cable-engaging section 60. The U-shaped body section 52 defines an externally arcuate concave cable-engaging surface 54.

Connector 12 is assembled in the following manner. Inner conductor 44 of cable 42 is terminated to inner contact 38 of terminal 30 by crimping, soldering or other method known in the art. A dielectric sleeve 39 is disposed over and beyond the crimped termination to protect and electrically isolate the inner contact 38 and inner conductor 44. The outer contact 40 is disposed over dielectric sleeve 39. The braid or outer conductor 46 of cable 42 is placed around the outer contact 40. In one embodiment as shown in FIG. 3, the cable bend controller 50 further includes an enlarged terminal engaging portion 58 that is insertable over the braid or outer conductor 46 and a crimp ferrule 64 is placed over enlarged portion 58. The outer contact 40, braid 46, bend controller portion 58 and ferrule 64 are then secured together by crimping, as shown in FIG. 4. After cable 42 has been terminated to terminal 30, the cable 42 is positioned along the cable engaging surface 54 and the second cable engaging section 60 is crimped around the cable 42, forming subassembly 66. Cable bend controller 50 thus provides a strain relief for the curved cable 42. In the embodiment shown second cable engaging section includes two arms 62 that extend initially to spaced-apart free ends which are formed around the cable 42 upon crimping, thereby defining subassembly 66. FIG. 3 further illustrates an optional insulating sleeve 88, which may be disposed on a cable 42 prior to inserting the end of the cable into the cable bend controller 50. The sleeve 88 is moved over the second cable engaging section and onto the curved portion of the subassembly and then is heat shrunk in place. Insulating sleeve 88 is shown "heat shrunk" to the cable subassembly 166 in FIG. 7.

First connector 12 is adapted to be mated to second connector 70, which in turn is secured to a circuit board 80 as shown in FIG. 4. Connector 70 includes a housing 72 and a plurality of terminals 76 having an inner contact 77 and outer contact 78 mated at one end to respective corresponding inner and outer contacts 38, 40 of connector 12 and electrically engaged at the other end to respective signal and ground circuits of circuit board 80.

Figure 7:
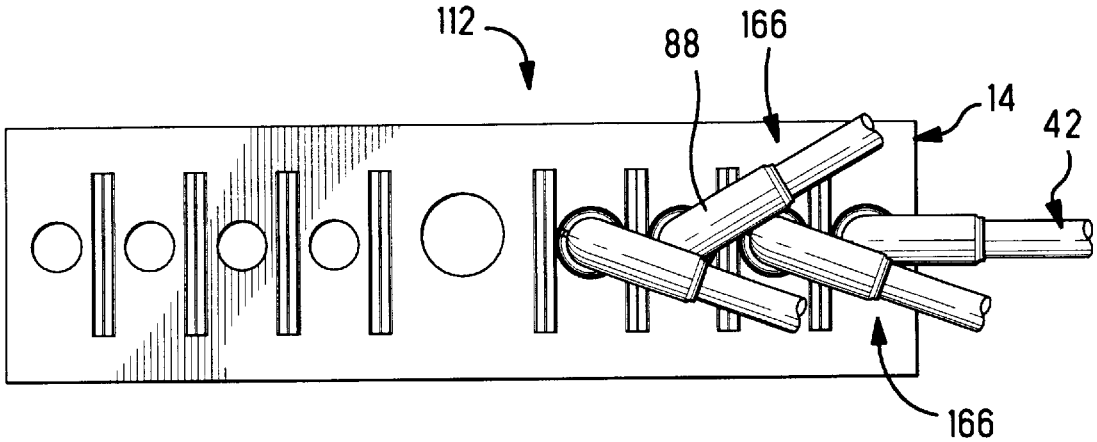
FIG. 7 is a flat plan view of the rear face of a cable assembly similar to that of FIG. 1 with the cables being routed in a different direction from the assembly.

As shown in FIGS. 1 and 2 the cables 42 are dressed substantially at a right angle to the axis of respective terminals 30, such that the cables 42 extend downwardly from connector 12 and at right angles to the planar surface of board 80. FIG. 7 illustrates another arrangement of the cables 42 wherein they are directed again at right angles from the connector housing 12 but are dressed such that they extend substantially parallel to the planar surface of board 80. In the embodiment shown subassemblies 166 are disposed in respective terminal receiving passageways 24 in a manner to permit the cable of each subassembly 166 to be dressed in a different direction if desired.

FIG. 7 also illustrates the use of insulating sleeves 88, which are "heat shrunk" over the cable bend controller 50 after crimping.

Figure 5:
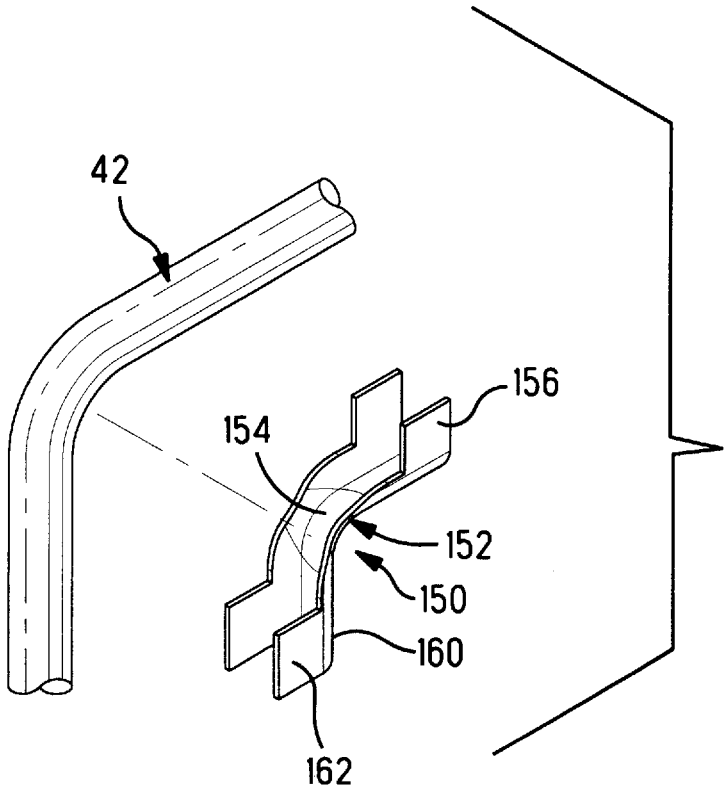
FIG. 5 is a perspective view of a cable controller exploded from a cable.
Figure 6:
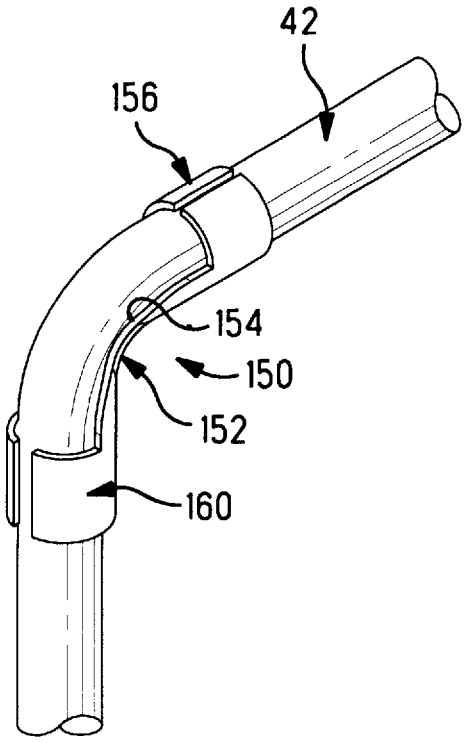
FIG. 6 is a perspective view of the cable controller of FIG. 5 attached to the cable.

FIG. 5 and 6 illustrate another embodiment 150 of the cable bend controller having a body section 152 and first and second cable-engaging sections 156, 160 extending at opposing ends thereof, each with arms that extend initially to spaced-apart free ends. The body section 152 is curved about a preselected radius and defines an externally arcuate concave cable-engaging surface 154. As shown in these figures, cable controller 150 is secured to the cable 42 at a location remote from a connector or other electrical article and is used to assure that the routed cable does not become "kinked" as it is directed to the appropriate locations.

Figure 8:
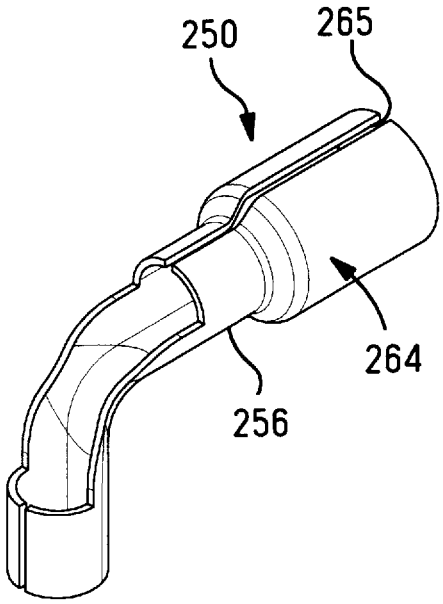
FIG. 8 is a perspective view of an alternative embodiment of the invention.

As shown in FIGS. 1–4 the cable bend controller 50 is a discrete device. In another embodiment 250 the crimp ferrule is formed as part of the controller as shown in FIG. 8. In this embodiment the crimp ferrule 264 and first cable engaging section 56 are formed into a ring and brazed or otherwise secured together at 265 by locking tabs or the like, as known in the art, prior to being slipped over the cable 42.

As shown in these Figures cable bend controller 50 is curved substantially at a 90° angle. It is to be understood that the angle may be other than 90° degrees.

The cable bend controller of the present invention provides a discrete member that can be disposed on a cable at any location there along to control the radius of a bend to prevent damage to the cable. It furthermore can be secured to a terminal and protect the cable as it extends axially from the terminal at a housing face to prevent damage to a coaxial cable or other cable extending outwardly from housing. It is used to direct the cable in a controlled fashion to a desired location.

It is thought that the cable bend controller of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A cable bend controller comprising:

a relatively rigid member including a body section having first and second cable-engaging sections at opposing ends thereof;

said first cable-engaging section being securable to said cable at a first location and said second cable-engaging section being securable to said cable at a second location spaced from said first location;

said first and second cable-engaging sections being adapted to be crimped to an outer jacket of said cable; and said body section being curved about a preselected radius such that said first cable-engaging section is oriented at a substantial angle to said second cable-engaging section, said body section thereby defining an externally arcuate concave cable-engaging surface;

whereby upon fastening said first and second cable-engaging sections to said cable, said cable is required to assume a bend to lie along said externally arcuate concave cable-engaging surface.

2. The cable bend controller of claim 1 wherein at least one said cable-engaging section has at least one arm extending from said body section to be clamped around an outer jacket of said cable by crimping.

3. The cable bend controller of claim 1 wherein at least one said cable-engaging section has a pair of arms extending from said body section to spaced apart free ends, said arms to be crimped around an outer jacket of said cable.

4. The cable bend controller of claim 1 wherein both said cable-engaging sections have a pair of arms extending from said body section to spaced apart free ends, said arms to be crimped around an outer jacket of said cable.

5. The cable bend controller of claim 1 wherein said externally arcuate concave cable-engaging surface extends about an angular distance of about 90°.

6. The cable bend controller of claim 1 wherein said first cable-engaging section is tubular and a tubular terminal engaging section extends forwardly therefrom having a diameter larger than said first cable-engaging section, and said second cable-engaging section is defined by a pair of arms extending from said body section to be crimped around and to an outer jacket of said cable.

7. An electrical connector comprising:

an insulative housing having a mating face and a cable-engaging face and at least one cable bend controller having a relatively rigid member including a body section having first and second cable-engaging sections at opposing ends thereof, said first and second cable-engaging sections being adapted to be crimped to an outer jacket of said cable, said first cable-engaging section being securable to a cable proximate said cable-engaging face of said housing and second cable-engaging section being securable to said cable at a second location spaced from said cable-engaging face, said body section being curved about a preselected radius such that said first cable-engaging section is oriented at a substantial angle to said second cable-engaging section, said body section thereby defining an externally arcuate concave cable-engaging surface;

whereby upon securing said controller to said housing with said first cable-engaging section at least adjacent said cable-engaging face, said cable is required to assume a bend to lie along said externally arcuate concave cable-engaging surface, extending from said housing.

8. The connector of claim 6 wherein said housing includes at least one terminal receiving passageway extending between said mating face and said cable-engaging face; and a terminal disposed in said at least one passageway, said terminal including a body portion having first and second connecting portions extending from opposed ends thereof, said first connecting portion being exposed for mating to a complementary terminal of a mating connector and said second connecting portion being terminated to a conductor of the cable.

9. The connector of claim 6 wherein at least one said cable-engaging section has at least one arm extending from said body section to be clamped around an outer jacket of said cable.

10. The connector of claim 6 wherein at least one said cable-engaging section has a pair of arms extending from said body section to spaced apart free ends, said arms to be crimped around an outer jacket of said cable.

11. The connector of claim 6 wherein both said cable-engaging sections have a pair of arms extending from said body section to spaced apart free ends, said arms to be crimped around an outer jacket of said cable.

12. The connector of claim 6 wherein said externally arcuate concave cable-engaging surface extends about an angular distance of about 90°.

13. The connector of claim 6 wherein said connector includes a plurality of terminals disposed therein and a plurality of said cable bend controllers for a like plurality of said cables.

14. The connector of claim 13 wherein said cable bend controllers are oriented alike for all said cables to extend in a common direction from said housing.

15. The connector of claim 14 wherein said externally arcuate concave cable-engaging surface of each said cable bend controller extends about an angular distance about 90° such that said cables extend orthogonally from said cable-engaging face.

16. The connector of claim 6 further including an insulating sleeve disposed around said at least one cable bend controller.

17. The connector of claim 6 wherein said first cable-engaging section is tubular and a tubular terminal engaging section extends forwardly therefrom having a diameter larger than said first cable-engaging section, and said second cable-engaging section is defined by a pair of arms extending from said body section to be crimped around and to an outer jacket of said cable.

18. A subassembly comprising:

a coaxial electrical cable having an inner conductor electrically isolated from an outer conductor, the outer conductor being surrounded by an insulating jacket;

a cable bend controller having a relatively rigid member including a body section having first and second cable-engaging sections at opposing ends thereof, said first cable-engaging section being tubular and adapted to be secured to said jacket of said cable at an end thereof and said second cable-engaging section being securable to said jacket of said cable at a second location spaced from said end, said body section being curved about a preselected radius such that said first cable-engaging section is oriented at a substantial angle to said second cable-engaging section, said body section thereby defining an externally arcuate concave cable-engaging surface, said first cable-engaging section further including a tubular terminal engaging portion extending forwardly therefrom and having a larger diameter than said first cable-engaging section;

an electrical terminal assembly including an inner contact electrically isolated from an outer contact by a dielectric member, said inner and outer contacts including respective connecting portions defined at a cable end for electrical connection with the inner and outer conductors of the cable; and a tubular crimping member having a forward section associated with the outer contact connecting portion, and a rearward section associated with the terminal engaging portion of the cable bend controller and having a diameter larger than said terminal engaging portion;

whereby upon inserting the cable end through said first cable-engaging section from rearwardly thereof terminating said inner contact of said terminal to said inner cable conductor, disposing said dielectric member over the terminated inner contact and inner conductor, said outer contact over said dielectric member, said outer conductor over said outer contact, said terminal engaging portion of said cable bend controller over said outer contact and said crimping member around said terminal engaging portion, and crimping said member, said outer conductor and outer contact are terminated and said cable bend controller is secured between said crimping member and said outer cable conductor.

* * * * *